US005739752A

United States Patent [19]

Tyren

[11] Patent Number: 5,739,752

[45] Date of Patent: Apr. 14, 1998

[54] METHOD IN DETECTING MAGNETIC ELEMENTS

[75] Inventor: Carl Tyren, Antibes, France

[73] Assignee: RSO Corporation, N.V., Curacao AN, Netherlands

[21] Appl. No.: 737,642

[22] PCT Filed: Apr. 25, 1995

[86] PCT No.: PCT/SE95/00453

§ 371 Date: Dec. 16, 1996

§ 102(e) Date: Dec. 16, 1996

[87] PCT Pub. No.: WO95/29468

PCT Pub. Date: Nov. 2, 1995

[30] Foreign Application Priority Data

Apr. 26, 1993 [SE] Sweden ..... 9401450

[51] Int. Cl.[6] ..... G08B 13/24

[52] U.S. Cl. ..... 340/551; 340/572; 324/309

[58] Field of Search ..... 340/551, 572, 340/505; 324/207.13, 226, 232, 236, 239, 309, 314

[56] References Cited

U.S. PATENT DOCUMENTS

| | | | |
|---|---|---|---|
| 4,492,922 | 1/1985 | Ohkubo | 324/207 |
| 4,647,917 | 3/1987 | Anderson, III et al. | 340/551 |
| 4,704,602 | 11/1987 | Asbrink | 340/551 |
| 4,710,752 | 12/1987 | Cordery | 340/551 |
| 5,005,001 | 4/1991 | Cordery | 340/551 |
| 5,049,857 | 9/1991 | Plonsky et al. | 340/551 |
| 5,160,888 | 11/1992 | Laukien | 324/309 |
| 5,300,922 | 4/1994 | Stoffer | 340/572 |
| 5,420,569 | 5/1995 | Dames et al. | 340/551 |
| 5,576,693 | 11/1996 | Tyren et al. | 340/551 |
| 5,621,316 | 4/1997 | Dames et al. | 324/207.13 |

FOREIGN PATENT DOCUMENTS

| | | |
|---|---|---|
| 96182 | 12/1983 | European Pat. Off. . |
| 21 67 627 | 5/1986 | United Kingdom . |
| WO 88/1427 | 2/1988 | WIPO . |
| WO 93/04538 | 4/1993 | WIPO . |
| 9314370 | 7/1993 | WIPO . |
| 9314478 | 7/1993 | WIPO . |

*Primary Examiner*—Brent A. Swarthout
*Assistant Examiner*—Vam T. Trieu
*Attorney, Agent, or Firm*—Merchant, Gould, Smith, Edell, Welter, & Schmidt, P.A.

[57] ABSTRACT

A method is suggested in detecting magnetic elements with a high magneto-mechanical coupling factor by means of magnetic signals. The elements are exposed to magnetic bias fields affecting the elements resonance frequencies, and the element properties affected by the bias fields are detected. The bias field is varied with regard to its magnitude within such intervals, that the presence of elements with known characteristics within the interval is determined, and with regard to its gradient so as to separate existing element positions. The bias field is given a homogenous nature with alternating field propagation directions, whereby elements located in the same plane are separated.

1 Claim, 2 Drawing Sheets

METHOD IN DETECTING MAGNETIC ELEMENTS

FIELD OF THE INVENTION

The invention refers to an improved method in detecting magnetic elements with a high magneto-mechanical coupling factor. In detecting many such elements, which exist in certain predetermined arrangements, a complicated detection method is carried out.

DESCRIPTION OF THE PRIOR ART

In previous patent specifications it has been suggested to use heterogenous bias fields to separate identical sets of elements located at different places within an interrogation zone. Regardless of how the elements are configured in order to provide each set with a certain code, a problem exists when it comes to rapidly linking together signals from individual elements into a group, corresponding to a label or the like.

WO-A-93/14478 discloses a method and a device for detecting objects in an interrogation zone. Each object is provided with a label, comprising a set of magnetic elements arranged in a predetermined code configuration so as to provide the label with an identity. The magnetic properties of the elements are determined by exciting the elements to oscillation and detecting the resonance frequency of each element. By exposing the interrogation zone with a plurality of different heterogeneous magnetic bias fields, it is possible to detect and separate all labels present in the interrogation zone. This is true also for labels with identical element code configuration, since the nominal values of the element resonance frequencies are offset to different extents thanks to the heterogeneous magnetic bias fields. If the number of possible element codes is large and/or if a large number of labels are present in the interrogation zone, many different bias fields have to be generated in order to completely and accurately detect all the labels.

BRIEF SUMMARY OF THE INVENTION

An object with the present invention is to render the detection of magnetic elements more effective by means of a number of preparatory measurements. This object is obtained by the method according to claim 1. Further objects and advantages are apparent from the following description and claims.

DESCRIPTION OF THE DRAWINGS

In the accompanying drawings.

DETAILED DESCRIPTION OF THE INVENTION

In order to facilitate a following detection of magnetic elements a series of settings for the magnetic bias field is initially carried out and followed by the detection of signals generated by the elements in the interrogation zone. Two series of settings for the bias field, the first of which having a constant bias field in any direction and the second of which having a bias field oriented in a particular direction with a gradient in any direction, aim at reducing the infinite number of possible positions for the elements to a finite number. A third series of bias fields aims at finding the exact number of elements in the interrogation zone, either by elimination of such positions, where there are no elements, or by separating the frequency response from a hidden element.

An element may be hidden, if for each bias field it responds at the same frequency as another element does. Theoretically, this is a very rare situation, but practically it is all the more frequent, as the frequency resolution of the electronic circuitry is poor. It has been found, that when two resonance frequencies are approaching each other, one of them suddenly disappears, before the two frequencies are equal. One solution to avoid hidden elements is therefore to increase the frequency resolution.

The first two series of bias fields are absolutely necessary and use a set of very different fields. The last series consists in adding intermediate bias fields.

It is an object of the invention to decrease the total number of bias fields and thus to make the reading or detection of elements or the like faster. This can be done through tracking. During the tracking intermediate bias fields are generated between two ordered fields. Consequently, all data given by the intermediate tracking bias fields can be stored and used at the end in order to find hidden elements, instead of generating new bias fields.

This is possible on two conditions:

first, care has to be taken that the intermediate fields generated by the tracking can form a good field for the third series of bias fields. This can be accomplished, if the proper laws of current variations in all the field generating coils are used between two bias fields to be generated;

second, the best bias field in the tracking between two generated bias fields must be possible to choose, so that new data are meaningful.

The purpose of the first series of bias fields is to reduce the infinite number of possible element orientations to a finite number of angle orientations (there is still no information regarding the element positions). This series of bias fields will now also be used for the purpose of detecting the length of each element.

Figure 1:
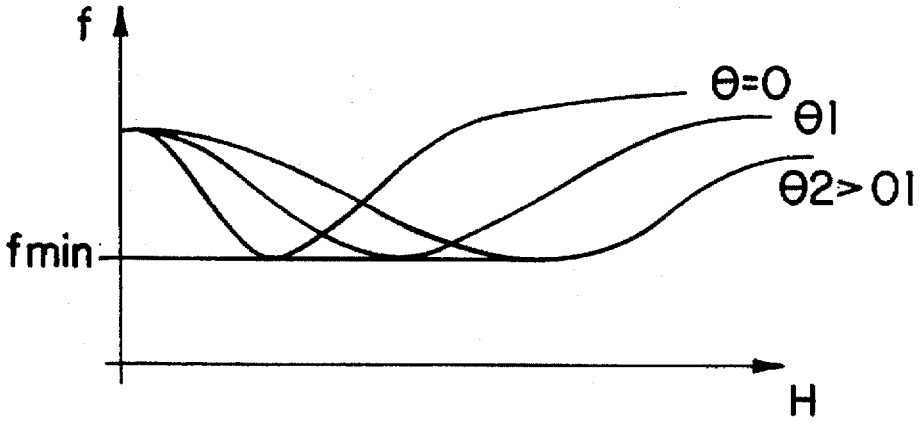
FIG. 1 is a graph showing the frequency response variation in relation to the magnitude of the applied bias field for different angles between the element and the magnetic field.

In order to detect the length of an element the frequency response of the element must be drawn versus the intensity of the bias field. At the drawing of this curve, when neither the position nor the orientation of the element is known, the best is to use a constant field. FIG. 1 shows the frequency response variation versus the magnitude of the applied bias field for different angles between the element and the magnetic field.

The value of the minimum frequency, $f_{min}$, gives the length of the element. The value of the magnitude of the bias field at the minimum frequency allows calculation of the angle of the element with respect to the bias field. If the angle is too wide (e.g., >80°), the frequency variations are very slow or the element cannot be detected. Instead of applying a fixed sequence of constant bias fields for a set of given orientations, the magnitude of the bias field will according to the invention be swept between a minimum value $H_{\alpha min}$ and a maximum value $H_{\alpha max}$ for the same set of given orientations.

There is another possibility to detect the element length directly without varying the magnitude of the bias field; namely by directly using the information given by the rotation of the fields. Thereby, the number of bias fields is reduced, but a slightly stronger magnetic field is required.

It is important to know the number of required orientations in the first series of bias fields. This number strongly depends on the maximum detection angle between the bias field and the element. It is already known, that at least three orientations are needed, since elements forming a 90° angle with the bias field cannot be detected.

According to the invention it has been calculated, that three different orientations are enough, if the maximum detection angle is more than 55°. In this case, if three orthogonal fields are used, there is always at least one bias field, the angle of which with the element is less than 55°.

Thus, it is very important to know the maximum angle of detection. The information will be needed in the general bias algorithm. In order to measure this value of the maximum angle of detection (between the bias field and the element) it is suggested, that this angle is measured for every element length. Once this value is known, the general bias algorithm may be adapted accordingly.

Once all possible element orientations have been obtained, a magnetic field orientation must be selected in order to detect a certain number of possible element positions by means of the second series of bias fields. This can be achieved by data processing of the information available. Once the direction has been selected, a bias algorithm may be used, which is part of the general bias algorithm, in order to detect a set of elements, which have mainly the same orientation. This means that all elements may be detected by a bias field with a given orientation. The algorithm uses a fixed sequence of bias fields. The adaptive bias field sequences are given either by the general RSO algorithm or by additional bias fields required for the detection of hidden elements. It is presumed, that hidden elements can be detected by means of intermediate bias fields in the tracking.

Figure 2:
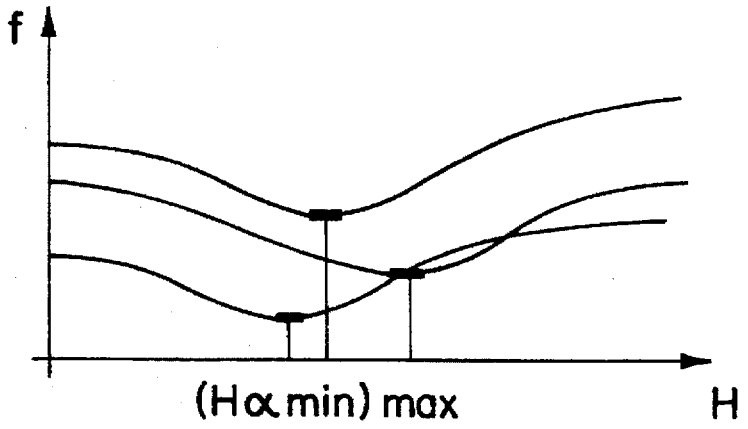
FIG. 2 is a graph showing the maximum value of $H_{\alpha min}$ in relation to the frequency.

To determine the element length a constant field must first be generated, the orientation of which is along OX (direction of detection) and the magnitude of which is $H_{\alpha min}$. There are several possibilities for the choice of $H_{\alpha min}$. The maximum value of $H_{\alpha min}$ is the minimum value of $H_{Frmin}$, where $H_{Frmin}$ is the value of the magnetic bias field strength at the minimum resonant frequency $F_{rmin}$, whatever length the element has; see FIG. 2. The minimum value of $H_{\alpha min}$ can be 0 or can be empirically determined.

Then the magnitude of the constant fields is smoothly increased until the value $H_{\alpha max}$ is reached using the tracking algorithm. The magnitude of $H_{\alpha max}$ will depend both on the maximum $H_{Frmin}$ value, regardless of the element length, and on the maximum $\alpha_{max}$ angle between the bias field and the detected element currently wanted. If $\alpha_{max}=55°$, $$H_{\alpha max}=\max(H_{Frmin})/\cos 55°=1.74 \max(H_{Frmin})$$

Thanks to the curves given by the tracking of the RSO algorithm, a set of elements has been found, the lengths of which have been possible to determine through the above-mentioned algorithm.

Thanks to the tracking between the two preceding ordered bias fields, it has also been possible to find out the angle between each element and the OX axis, but the exact element orientations are not yet known. In order to determine these at least two other bias fields with different orientations are required.

The angle determination is made correctly with the general bias algorithm.

The angle information obtained by the previous bias field is enough to calculate a finite number of possible angles, and the statistics computations of the RSO algorithm work in this way. In practice, the only restriction due to the non-knowledge of the exact element orientations is, that it has to be presumed, that it is impossible to position two elements at the same place; elements, the angles with the OX axis of which are the same.

Now a list is provided of detected elements with their respective length. There may be hidden elements not detected, because their frequency response is the same as the frequency response of another element. Such hidden elements can be found by applying a fixed sequence of three bias fields with gradients in three orthogonal directions.

First bias field: magnetic field along the OX direction with a gradient along the OX direction.

Second bias field: magnetic field along the OX direction with a gradient along the OY direction.

Third bias field: magnetic field along the OX direction with a gradient along the OZ direction.

Each and everyone of these three fields is an approximation of a first order vectorial polynomial function. Thus, each detected frequency for each bias field gives rise to a first order equation, which is very easy to solve. Thanks to the tracking it is possible to compute each element position, and a hidden element should no longer exist except in rare cases. Care has to be taken between two bias fields to make a correct rotation of the gradients, so that intermediate data of the tracking algorithm can be used to solve possible problems with hidden elements.

Figure 3:
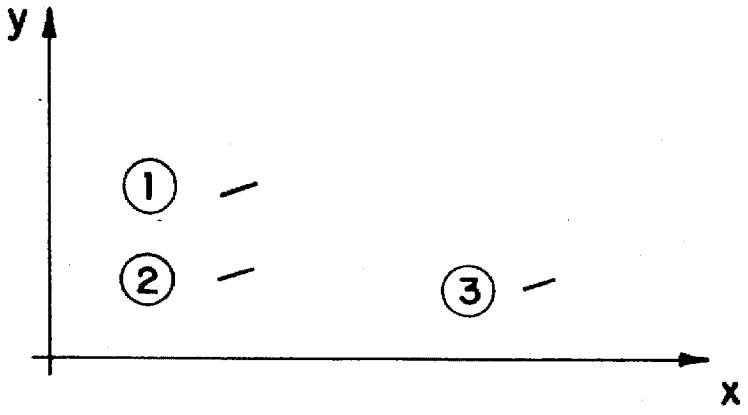
FIG. 3 is a schematic view of the positions for three elements.

By means of trial it will be studied, how an element can be hidden and how to use tracking algorithm data to solve all cases of hidden elements. In these trials, the FIG. 3 situation in three dimensions is studied.

When a bias field is applied with a gradient along the OX direction, elements 1 and 2 will resonate with the same frequency. When the gradient is along the OY direction, also elements 2 and 3 respond with the same frequency. For these two bias fields only two elements are consequently detected, while there in fact are three elements, one of which is hidden.

The solution to the problem is to apply an additional bias field, which gradient is along the (1,1) direction. Three separate frequencies can then be detected.

Figure 4:
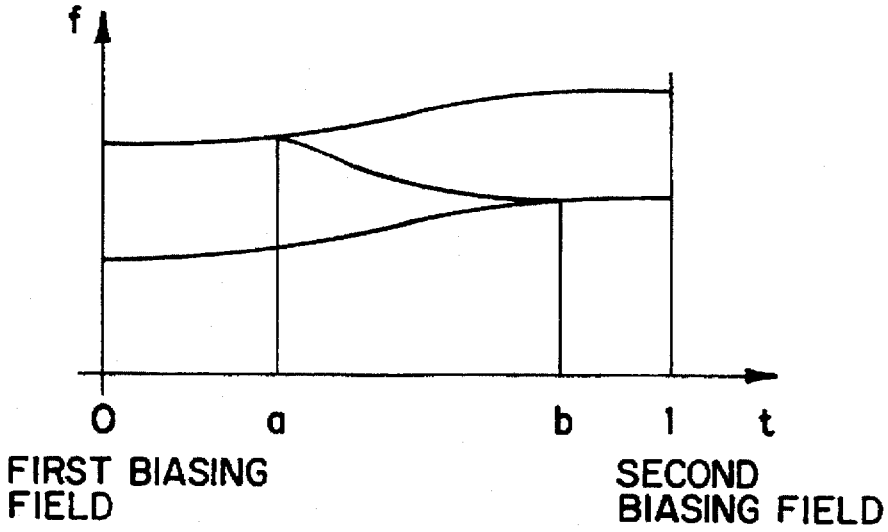
FIG. 4 is a graph showing the frequency variation as a function of $t \in [0,1]$.
Figure 5A:
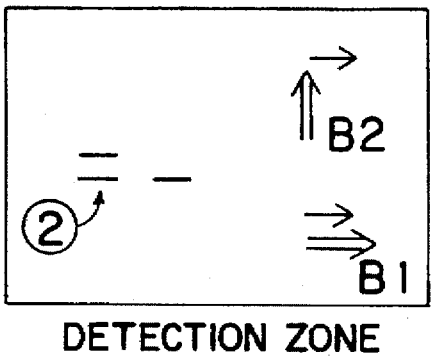
FIG. 5 is a graph showing the theoretical frequency response from element number 2.
Figure 5B:
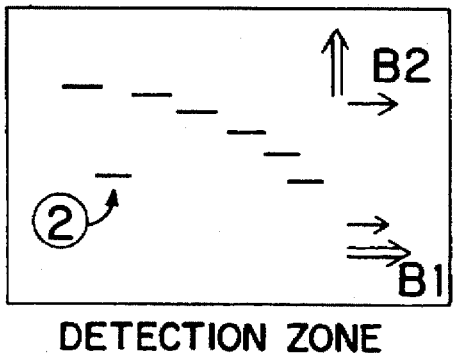
Figure 5C:
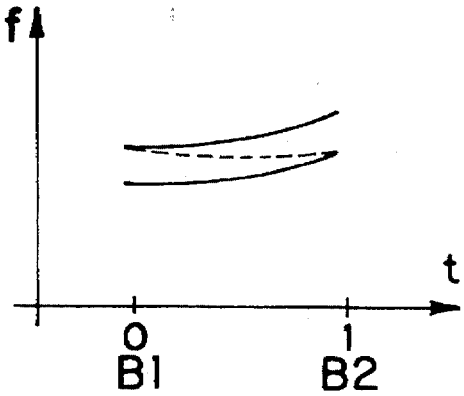
Figure 5D:
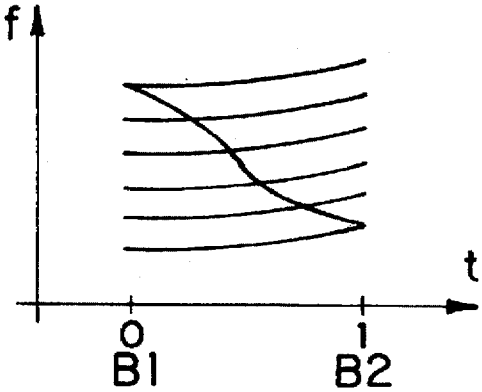

If the gradient is suitably rotated during the tracking between the first and the second bias fields, the additional bias field is generated already during the bias sequence. All necessary data are thus already available. The curve obtained by the tracking will be according to FIG. 4, where the third element is detected between a and b.

This technique may not work, if the three elements are located too close to each other of if too large a number of elements are present. In both cases the element 2 is, so to speak, "shielded" and cannot be detected according to FIG. 5.

The theoretical frequency response of element 2 is given by the dashed line, but the element can not be seen during the tracking. There is a shielding effect. The tracking is made between the bias fields B1 and B2. Both bias fields are represented in the figure. The simple arrow represents the magnetic field direction, and the double arrow represents the gradient direction.

The trials described above aim at finding the limits where an element is shielded. It can be observed, that the notion of a shielded element is a generalization of the notion of a minimum distance between two elements, if both of them should be detected. The trials also give the minimum distance between two elements.

I claim:

1. A method for detecting magnetic elements in an interrogation zone by means of magnetic signals, each magnetic element having a high magneto-mechanical coupling factor, wherein properties of length, orientation and position, of the elements in the interrogation zone are detected by exposing the elements to a plurality of different magnetic bias fields affecting the resonance frequencies of the elements and by detecting frequency responses of the elements for each magnetic bias field, characterized by:

exposing the elements to a first series of magnetic bias fields, each magnetic bias field of said first series being spatially homogeneous, having a magnitude which does not vary in the interrogation zone;

exposing the elements to a second series of magnetic bias fields, each magnetic bias field of said second series having a spatial gradient in a different direction, having a magnitude which varies in the interrogation zone; and exposing the elements to magnetic bias fields intermediate the magnetic bias fields of said second series, the intermediate magnetic bias fields being generated by rotating the gradients of magnetic bias fields of said second series.

* * * * *

UNITED STATES PATENT AND TRADEMARK OFFICE

CERTIFICATE OF CORRECTION

PATENT NO. : 5,739,752

DATED : APRIL 14, 1998

INVENTOR(S) : TYREN

It is certified that error appears in the above-indentified patent and that said Letters Patent is hereby corrected as shown below:

Front page, [30] Foreign Application Priority Data: "April 26, 1993" should read --April 26, 1994--

Front page, [30] Foreign Application Priority Data: "9401450" should read --9401450-3--

Front page, [57] Abstract, line 12: "homogenous" should read --homogeneous--

Signed and Sealed this

Second Day of November, 1999

*Attest:*

*Attesting Officer*

Q. TODD DICKINSON

*Acting Commissioner of Patents and Trademarks*